US008356766B2

(12) United States Patent
Garthaffner

(10) Patent No.: US 8,356,766 B2
(45) Date of Patent: Jan. 22, 2013

(54) WINDER FOR RECTANGULAR CROSS-SECTION WIRE

(75) Inventor: Joseph M. Garthaffner, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 333 days.

(21) Appl. No.: 12/924,028

(22) Filed: Sep. 14, 2010

(65) Prior Publication Data

US 2012/0312477 A1 Dec. 13, 2012

(51) Int. Cl.
*B21F 3/04* (2006.01)

(52) U.S. Cl. ..... 242/437.3; 242/446

(58) Field of Classification Search ..... 242/431, 242/437, 437.3, 443, 446
See application file for complete search history.

(56) References Cited

U.S. PATENT DOCUMENTS 3,125,133 A * 3/1964 Klingensmith et al. ..... 140/92.2
4,699,184 A * 10/1987 Macemon et al. ..... 140/92.2
5,465,478 A * 11/1995 Anderson et al. ..... 29/748
6,283,403 B1 9/2001 Braun et al. ..... 242/532.2
6,560,854 B2 5/2003 Nam et al. ..... 29/605
6,873,235 B2 * 3/2005 Fiske et al. ..... 335/306
6,986,203 B2 1/2006 Chiu ..... 29/896.9
7,341,218 B2 3/2008 Tellier et al. ..... 242/575.7
7,444,919 B1 11/2008 Mansfield ..... 89/9

* cited by examiner

*Primary Examiner* — Emmanuel M Marcelo
(74) *Attorney, Agent, or Firm* — Gerhard W. Thielman, Esq

(57) ABSTRACT

A device is provided for winding wire into a coil. The device includes a shaft for turning on an axis; a hub attached to the shaft; inner and outer wheels; a mandrel having an outer radial surface for looping the wire; and a guide connectable to the mandrel and extending past the inner wheel. The shaft is structurally supported by a housing. The inner wheel, mandrel and outer wheel are removably fastened to the hub, the wire passes along the guide and lays along the radial surface of the mandrel, and the shaft rotates for looping the wire around the mandrel. The shaft can be rotated either manually or by a motor. A system is provided that includes the winding device, and further includes a wire-feed device, particularly for arranging several strands of wire into a ribbon.

15 Claims, 7 Drawing Sheets

WINDER FOR RECTANGULAR CROSS-SECTION WIRE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to wire winding devices. In particular, the invention provides an apparatus for winding wire having a square or rectangular cross-section.

Efforts to incorporate instrumentation in gun-launched projectiles are adversely affected by damage to sensitive electronics from propellant-induced sudden acceleration. To mitigate this condition, development has been initiated of launchers having more gradual acceleration by using electromagnetic induction-motors, such as for example in U.S. Pat. No. 7,444,919 (under Navy Case 97941). To maximize magnetic field density, coated copper wire that incorporates rectangular cross-sections have been investigated to flow electric current there-through to induce the Lorentz-force motive fields.

SUMMARY

Conventional wire winding apparatuses yield disadvantages addressed by various exemplary embodiments of the present invention. In particular, conventional wire winding devices are limited to round wire due to twist from spooling torsion. Various exemplary embodiments provide a device for winding wire into a coil. The device includes a shaft for turning on an axis; a hub attached to the shaft; inner and outer wheels; a mandrel having an outer radial surface for looping the wire; and a guide connectable to the mandrel and extending past the inner wheel. The shaft is structurally supported by a housing.

The inner wheel, mandrel and outer wheel are removably fastened to the hub, the wire passes along the guide and lays along the radial surface of the mandrel, and the shaft rotates for looping the wire around the mandrel. The shaft can be rotated either manually or by a motor. Other various embodiments provide a system that includes the winding device, and further includes a wire-feed device, particularly for arranging several strands of wire into a ribbon.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Winding wire around a cylindrical mandrel induces twist as the wire is wound in circular or helical fashion. Typical wire having a circular cross-section readily conforms to such twisting, as such configurations maintain symmetry irrespective of angular orientation. By contrast, rectangular- or square-cross-section wire possesses quadrilateral symmetry, rather than axial symmetry.

Thus, such twisting disturbs uninterrupted layup of wire having rectangular cross-section, thereby inducing voids and non-homogeneous distribution of the conductive material. To mitigate this condition, various exemplary embodiments provide a wire winder system that addresses the peculiarities of winding rectangular cross-section wire.

Figure 1:
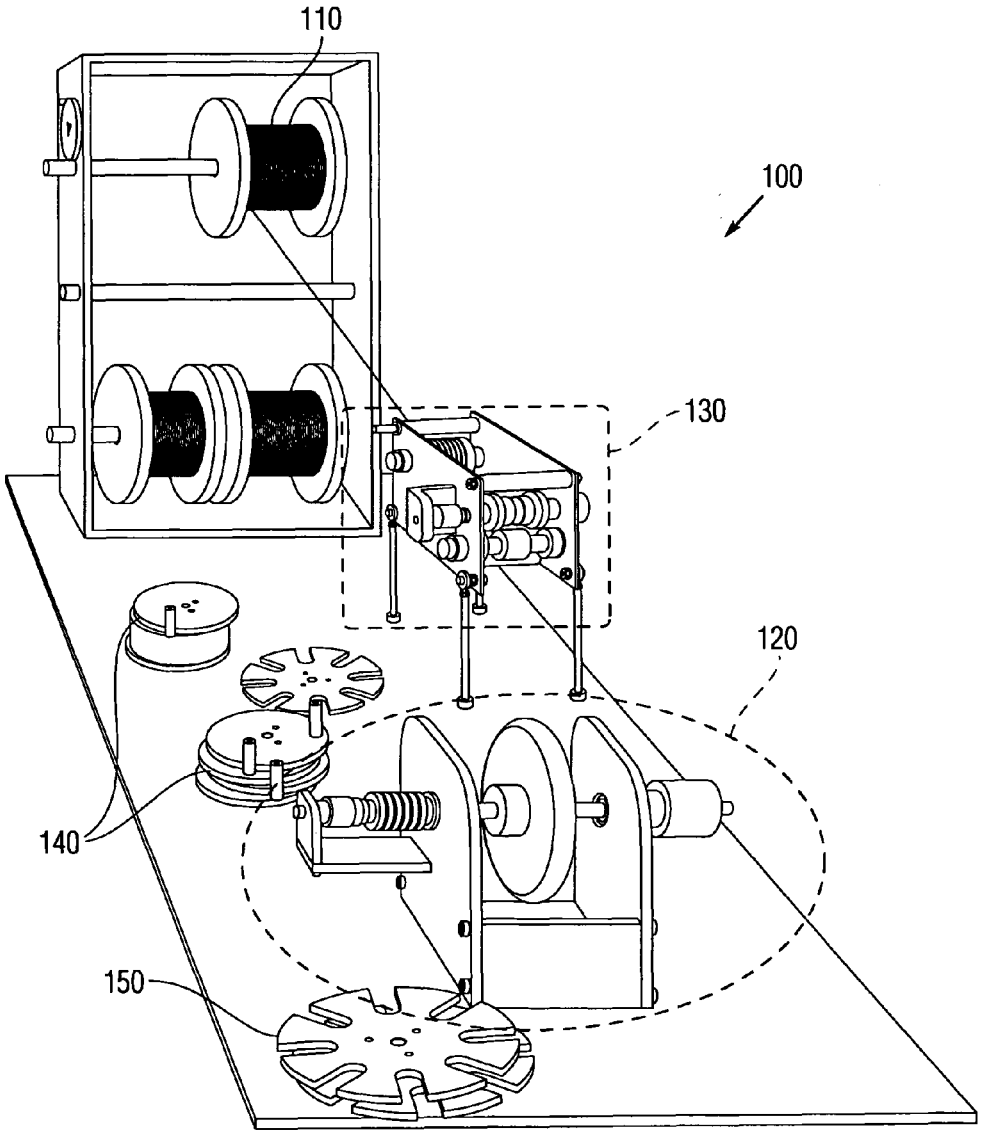
FIG. 1 is a perspective view of a wire winding system.

FIG. 1 shows a perspective view 100 of a wire-feed and winding system. A feed spool 110 is suspended on a rack to provide copper wire having a rectangular or square cross-section. The wire inserts into a wire-feed device 120 for direction to a wire winding device 130, both supported by a platform, such as a table. Interchangeable components include mandrels 140 around which the wire can be wound for application, and pinwheels 150 to secure the mandrel 140 in the winder 130.

Figure 2A:
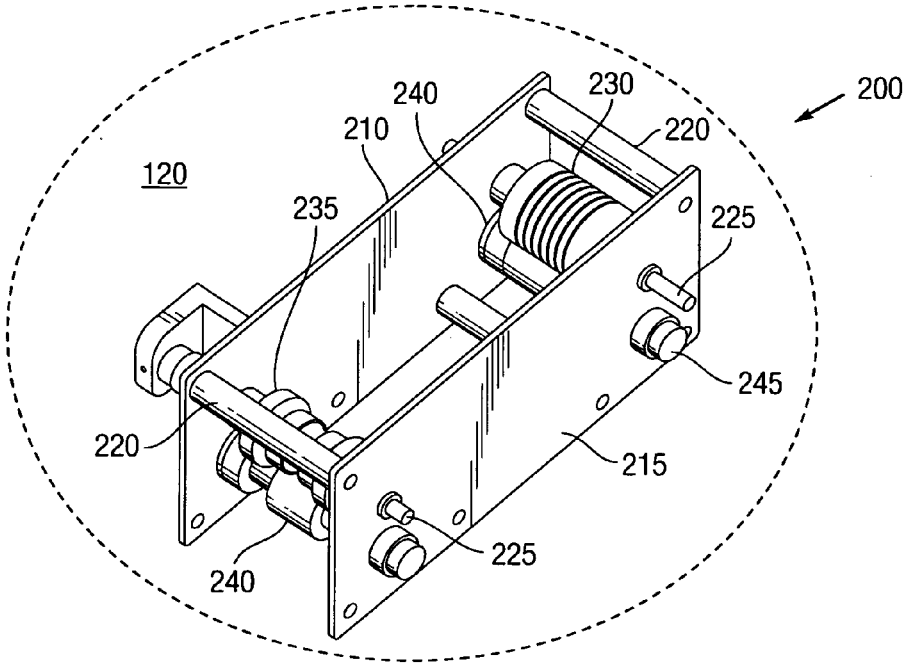
FIGS. 2A and 2B are isometric assembly views of a wire feeding device.

FIG. 2A shows a first isometric view 200 of the wire-feed device, also called a feeder and shown within a dash oval as the feed assembly 120 illustrated facing partially forward. A pair of tension plates on the starboard-side 210 and port-side 215 are disposed parallel to each other separated by a distance and joined to each other by four plate separator shafts 220. Between the plates 210 and 215, a pair of spool shafts 225 each suspend an in-feed alignment spool 230 and an out-feed tensioning spool 235 at respective the distal and proximal ends of the feed assembly 120. A pair of friction rollers 240 below the spools 230 and 235 (i.e., upstream and downstream of the source spool 110) are also suspended from friction roller shafts 245 between the plates 210 and 215.

Figure 2B:
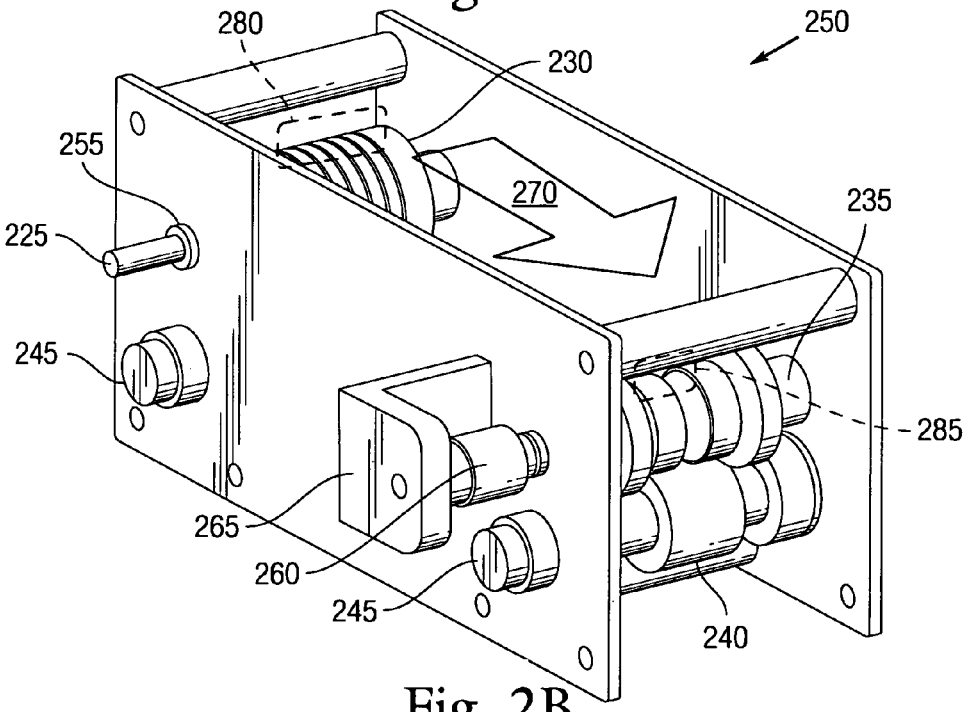

FIG. 2B shows a second isometric view 250 of the wire-feed device 120, also facing partially forward. The spool shafts 225 are laterally secured to the plates 215 and 220 by a set of four bearings 255. An overrun adjustable friction clutch 260 attaches to that spool shaft 225 for the out-feed spool 235. A clutch torsion bracket 265 extends beyond the starboard-side plate 210. At least one strand of wire from the source spool 110 can be disposed to roll along the in-feed spool 230 towards the out-feed spool 235 along a feed direction 270. The wire then proceeds to the winding device 130.

Several wire strands from multiple feed spools 110 can be concatenated together in a linearly disposed ribbon. In the configuration shown, the in-feed spool 230 includes six grooves 280 to lead the wires along the direction 270 towards the out-feed spool 235 with a single wide groove 285 for submitting the ribbon to the winding device 130.

Figure 3:
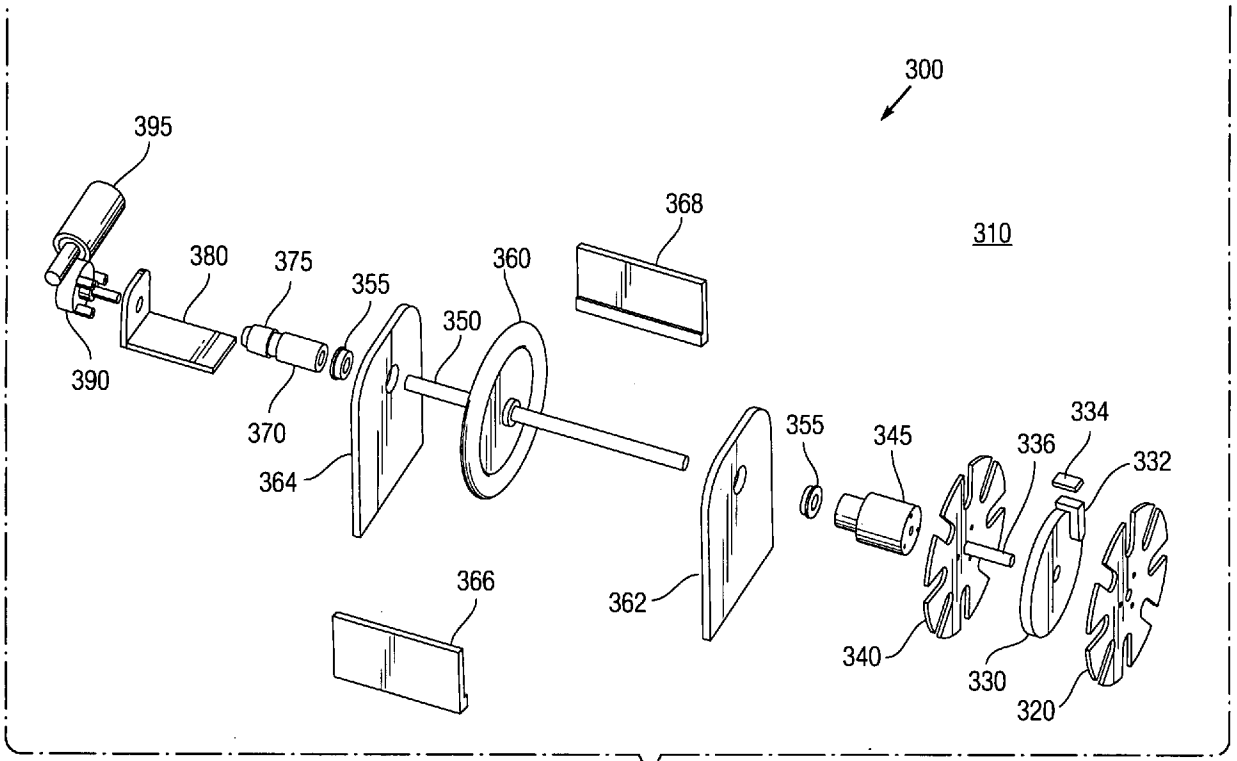
FIG. 3 is an isometric exploded view of a wire winding device.

FIG. 3 shows an isometric exploded view 300 of a wire winding device 130, also called a winder, shown as a set of component winder parts 310 that receives the wire from the feeder 110. The parts 310 are identified as follows: An outer pinwheel 320 is disposed at the proximal end, behind which is a coil mandrel 330, which are interchangeable with components in the system view 100 labeled by the mandrel 140, whose diameter depends on the wire assembly desired.

Additional components associated with the mandrel 330 include a wire finish clamp base 332, a wire finish clamp 334 and an in-feed wire guide 336. Screws or alternate fasteners may be used to secure the wire guide 336 to the mandrel 330 for looping the wire.

Upon completion of the winding process, screws may be used to secure the base 332 to the mandrel 330 and then screws may be used to secure the clamp 334 to the base 332 for maintaining the wire arrangement on the mandrel 330. Alternatively, other types of fasteners may be used to secure the base 332 and the clamp 334. An inner pinwheel 340 is disposed behind the mandrel 330, which can be identical in size and shape to the outer pinwheel 320. The pinwheels 320 and 330 are shown as interchangeable components in the system view 100 labeled by pinwheel 150. A plate attachment hub 345 is disposed behind the inner pinwheel 340.

The mandrel 330, pinwheels 320 and 340, and the hub 345 rotate along a main drive shaft 350 suspended on a first axle bearing 355. The shaft 350 can optionally be turned by a crank wheel 360. The example illustrated represents a configuration for hand-power, but artisans of ordinary skill will recognize that alternate modes for providing necessary torque can be availed without exceeding the scope of the invention.

The crank wheel 360 resides within a frame that includes fore and aft torsion plates 362 and 364 separated by port and starboard support plates 366 and 368. Suspending from a second bearing 355, the shaft 350 extends beyond the aft plate 364 to an overrun friction clutch 370 to prevent backlash and coupled to a reduction coupler 375. A clutch torsion bracket 380 provides an attachment to the aft plate 364 for a worm gear 390 that connects to the shaft 350 and is powered by a drive motor 395.

The worm gear 390 enables rotation in one direction to maintain tension in the wire during winding. The drive motor 395 provides motive torque for turning the shaft 350, as an automatically driven alternative to manually operating the crank wheel 360. Artisans of ordinary skill will recognize that either the crank wheel 360 or the gear 390 with motor 395, or else both mechanisms can be employed for the winder 130 without departing from the spirit of the invention.

Figure 4:
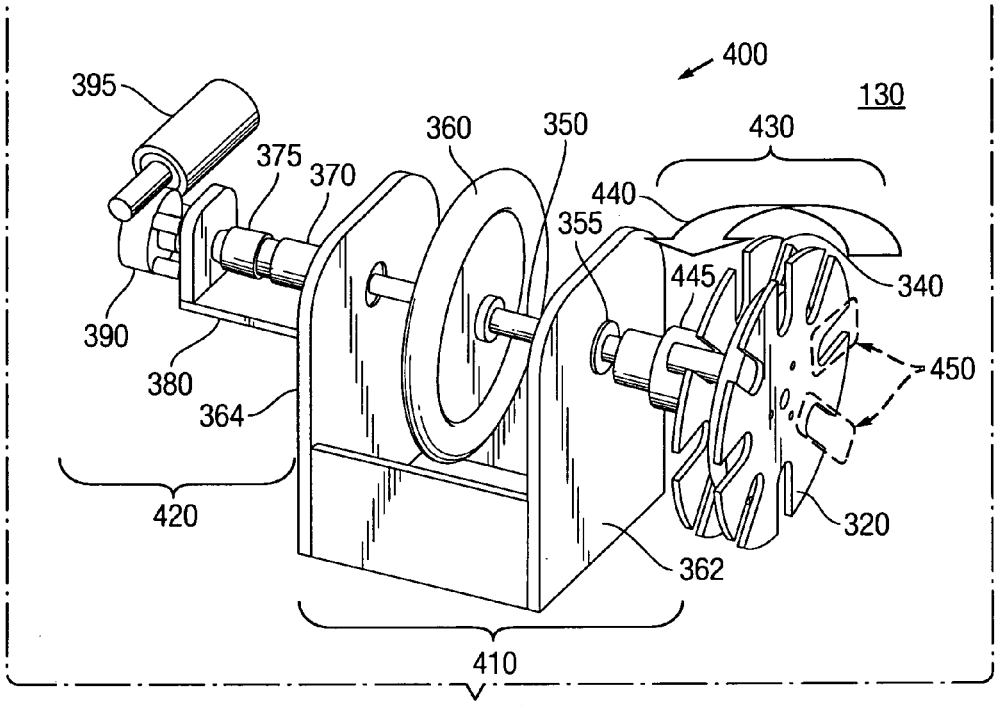
FIG. 4 is an isometric assembly view of the wire winding device.

FIG. 4 shows an isometric assembly view 400 of the wire winding device 130, as an assembly. The components 310 are shown with the shaft 350 extending beyond an assembled frame 410 with the crank wheel 360 within. A gear drive sub-assembly 420 attaches to the shaft 350 at the distal end, whereas a wire coiling sub-assembly 430 attaches to the shaft 350 at the proximal end. Select components 310 are identified that correspond to their respective subassemblies. The shaft 350, the pinwheels 320 and 340 and the mandrel 330 rotate counterclockwise 440 as facing the proximate end.

Each of the pinwheels 320 and 340 include radial slots 450 through which wire can be guided and pass through. In the example shown, each pinwheel 320 and 340 includes eight slots 450 angularly separated by forty-five degrees (45°) or $\pi/4$ radians. Those of ordinary skill will recognize that the number of slots 450 can be altered to facilitate application of liquid adhesive along each layer of wire. Furthermore, although single quantities of the base 332, clamp 334 and guide 336 are illustrated, additional sets of these items can be provided for separate mandrels 330 with which to spool additional wire. Moreover, any slot 450 may be used in this process without departing from the spirit of the invention.

Wire from the source spool 110 passes through the feed device 120 to the hub 345 for a few turns. An operator directs the wire over the wire guide 336 attached to the mandrel 330 and passing through the inner pinwheel 340 at one of the slots 450. The wire passes through that slot 450 to lay along the outer radial surface of the mandrel 330. For a single strand, the wire can wind to lay adjacent a previously wound loop on the mandrel 330. For multiple strands, the wires can wind to lay flat upon the mandrel 330 as a ribbon.

Upon completion of a layer of wire loops, the operator can apply adhesive to the wires to sure their arrangement after winding is complete. This process may be repeated until the final layer has been laid on the mandrel 330. After completion of laying wire on the mandrel 330, the base 332 and clamp 334 may be secured to the mandrel 330 to prevent axial slippage of the wire. Subsequently, the subassembly 430 may be disassembled and the mandrel 330 removed for the adhesive to cure. After the adhesive has hardened, the wire coil may be removed from the mandrel 330 for its destined application and the mandrel reused for an additional coil.

Figure 5:
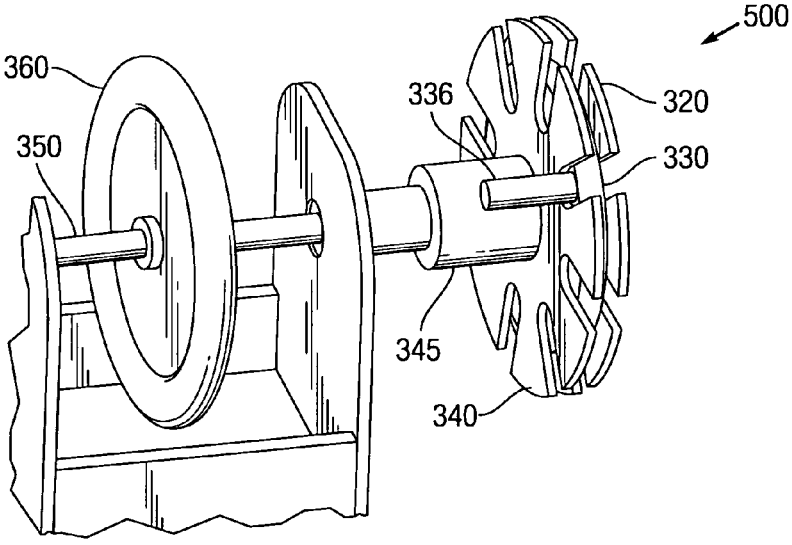
FIGS. 5 and 6 are isometric detail views of the wire winding device.
Figure 6:
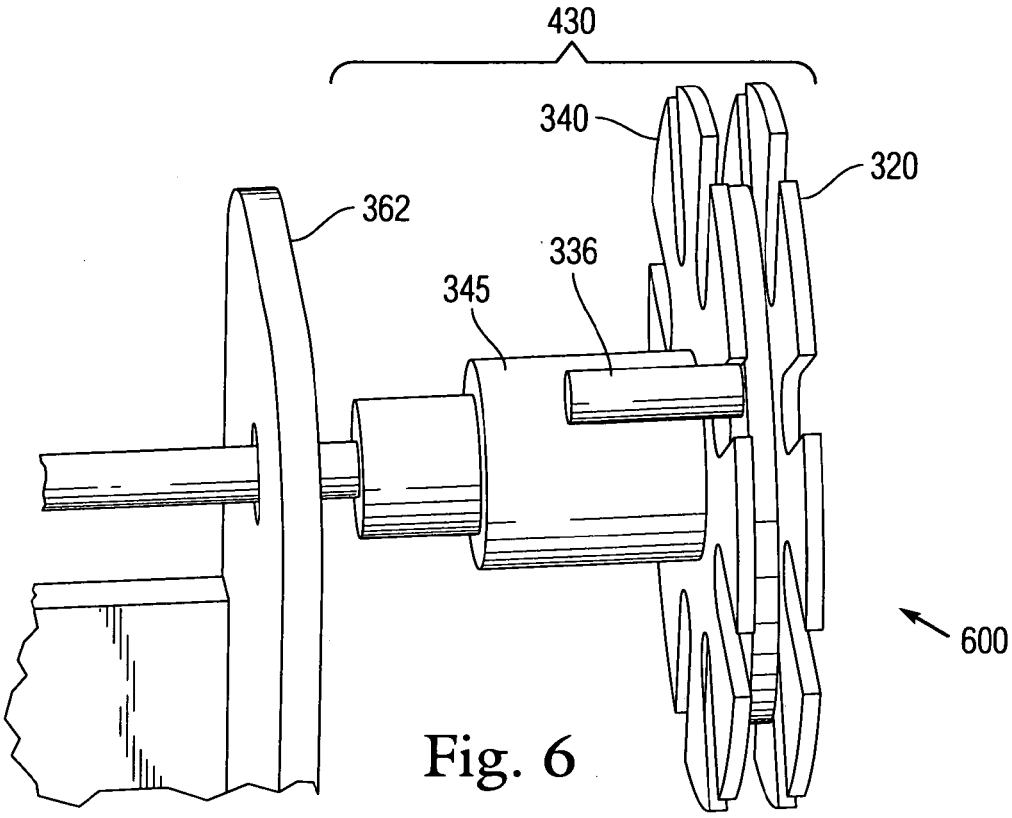
Figure 7:
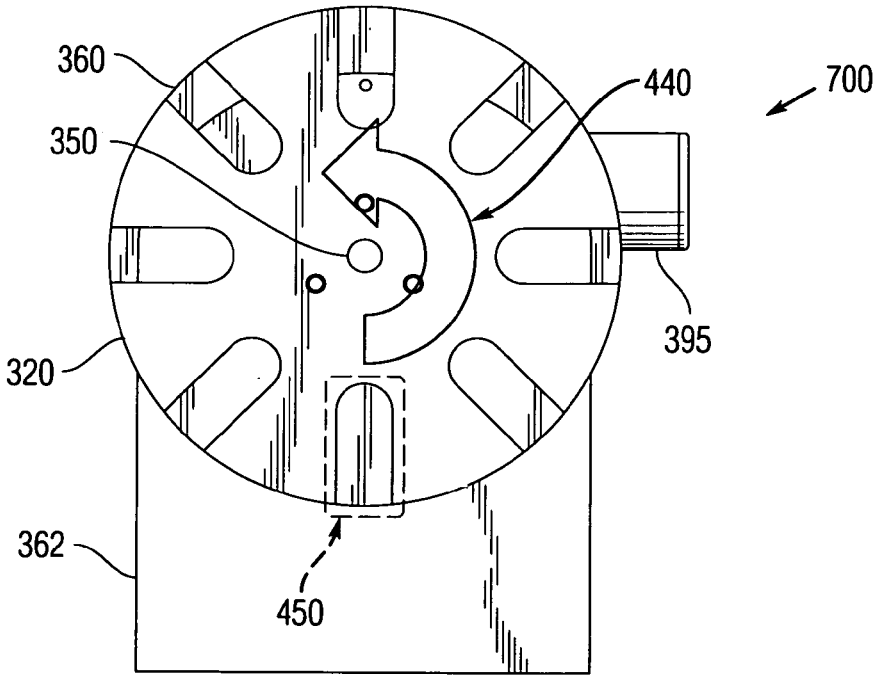
FIG. 7 is a plan view of the wire winding device as observed looking aft.

FIGS. 5 and 6 show first and second isometric detail views 500 and 600, respectively, in which the wire guide 336 is disposed forward from the mandrel 330 through the inner pinwheel 340. FIG. 7 shows an elevation view 700 from the proximal end of the wire coiling sub-assembly 430. The flywheel 320 and crank wheel 360 are shown to be aligned together on the shaft 350 and rotating counterclockwise 440, and the angular distribution of the slots 450 as described can be verified from its initial isometric view 400.

Figure 8:
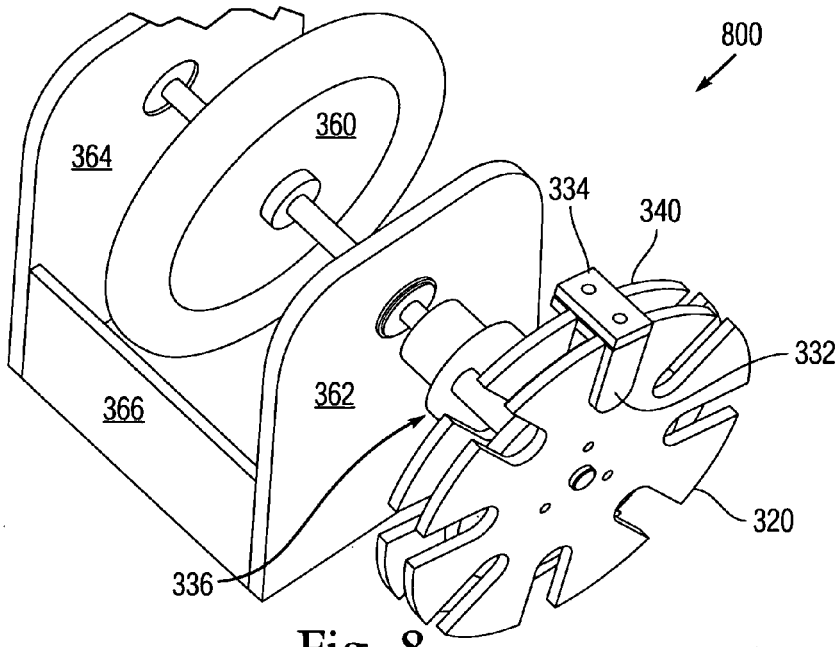
FIG. 8 is an isometric detail view of the wire winding device.
Figure 9:
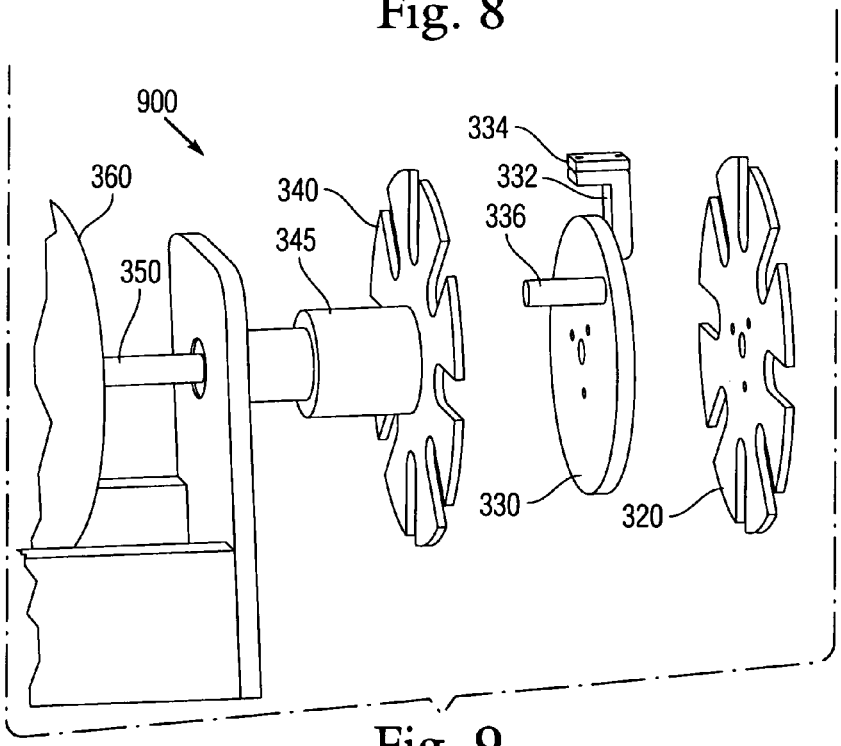
FIG. 9 are isometric disassembly detail view of the wire winding device.

FIG. 8 shows a third isometric detail view 800, while FIG. 9 shows an isometric detail disassembly view 900, both of the wire coiling sub-assembly 440. The wire guide 332 and accompanying finishing clamp 334 are disposed between the mandrel 330 and the outer pinwheel 320.

Figure 10:
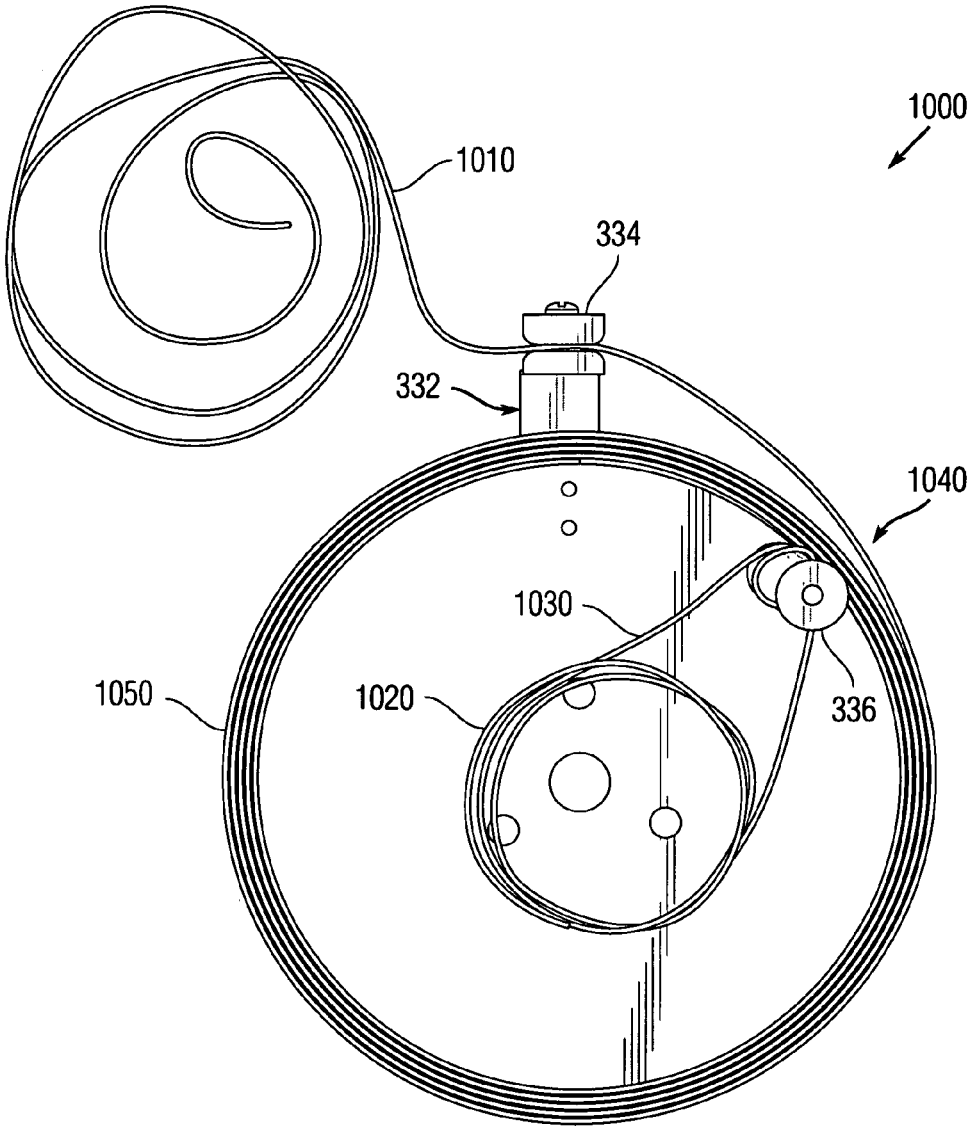
FIG. 10 is a plan perspective view of a wound wire.

FIG. 10 shows a perspective view 1000 of a wire 1010 after winding and removal from the mandrel 330. The wire 1010 initially feeds to be wound around the hub 345 at loops 1020 to be directed at extension 1030 around the guide 336 and secured by clamp components 332, 334 to form a wire winding coil 1040.

Conventional methods of winding these coils employed an unrefined impromptu device, without the capability to hold the arranged loop to close tolerance. Also the conventional device had only the capability to wind a single coil per day, and lacked tensioning abilities for maintaining the coils of wire tight around its core.

Common methods for making coils in an industrial application include automated machinery. Such conventional machinery typically uses a coated wire with round cross-section for making the coils. High current density applications require coils of rectangular cross-section wire incompatible with commercially available equipment.

Various exemplary embodiments enable an operator to expeditiously wind several inductive coils in a short period of time while maintaining close geometric tolerances on a consistent basis. In addition, various exemplary embodiments enable a rectangular or square wire to be wound into coils.

Such cross-section creates complexity in the coil fabrication process so the embodied device is capable of manipulating the special wires.

The process for winding wires can be identified as follows:

Feed at least one wire into the in-feed alignment spool 230 and then through the out-feed tensioning spool 235;

Then pull the wire onto and past the winder 130 to create leader for subsequent application of the coil;

Take the end of the wire and wrap the wire around the guide 336;

Wrap the rest of the wire around the drive hub 345 by rotating the drive assembly 360 or 430;

Feed the wire onto the mandrel 330 in between the pin-wheel plates 320 and 340;

Wrap the wire and apply glue to eight points at the slots 450 around the coil until reaching the number of coil wraps desired;

Attach the outer coil wire fastener 1020 to the mandrel 330 and clamp the wire in place while maintaining tension;

Remove the mandrel 330 from the winder 130 and trim the wire off with some length remaining for later wiring operations;

Hang the mandrel 330 up to let the glue dry for 24 hours;

Once the glue is dry, remove the outer coil wire clamp 332, 334 and slip off the coil from the mandrel 330; and Repeat as necessary.

While certain features of the embodiments of the invention have been illustrated as described herein; many modifications, substitutions, changes and equivalents will now occur to those skilled in the art. It is, therefore, to be understood that the appended claims are intended to cover all such modifications and changes as fall within the true spirit of the embodiments.

What is claimed is:

1. A device for winding wire into a coil, said device comprising:

a shaft for turning on an axis, said shaft being structurally supported;

a hub attached to said shaft;

inner and outer wheels;

a mandrel having an outer radial surface for looping the wire; and a guide connectable to said mandrel and extending past said inner wheel, wherein said inner wheel, mandrel and outer wheel are removably fastened to said hub, the wire passes along said guide and lays along said radial surface of said mandrel, and said shaft rotates for looping the wire around said mandrel.

2. The device according to claim 1, further comprising a driver mechanism for turning said shaft.

3. The device according to claim 2, wherein said mechanism is a motor.

4. The device according to claim 2, wherein said mechanism is a hand crank.

5. The device according to claim 1, further comprising a clamp for holding the wire in said mandrel for removal of said mandrel from said wheels.

6. The device according to claim 1, wherein each said wheel includes at least one slot for access to the wire on said mandrel with which to apply adhesive.

7. The device according to claim 1, wherein the wire has a rectangular cross-section.

8. A system for winding at least one strand of a wire from a source spool into a coil, said system comprising:

a wire-feed device for receiving the wire from the source spool and disposing the strand along a feed direction; and a winding device for receiving the wire from said wire-feed device and looping the wire around a mandrel to produce the coil, said winding device including:

a shaft for turning on an axis, said shaft being structurally supported;

a hub attached to said shaft;

inner and outer wheels;

a mandrel having an outer radial surface for looping the wire; and a guide connectable to said mandrel and extending past said inner wheel, wherein said inner wheel, mandrel and outer wheel are removably fastened to said hub, the wire passes along said guide and lays along said radial surface of said mandrel, and said shaft rotates for looping the wire around said mandrel.

9. The system according to claim 8, further comprising a driver mechanism for turning said shaft.

10. The system according to claim 9, wherein said mechanism is a motor.

11. The system according to claim 9, wherein said mechanism is a hand crank.

12. The system according to claim 8, further comprising a clamp for holding the wire in said mandrel for removal of said mandrel from said wheels.

13. The system according to claim 8, wherein each said wheel includes at least one slot for access to the wire on said mandrel with which to apply adhesive.

14. The system according to claim 8, wherein the wire has a rectangular cross-section.

15. The system according to claim 8, wherein said wire-feed device further includes:

first and second rollers disposed upstream and downstream of the source spool;

an in-feed spool having a plurality of grooves for passing a plurality of strands separately between said in-feed spool and said first roller; and an out-feed spool having a wide groove for passing said plurality of strands as a ribbon between said out-feed spool and said second roller.

* * * * *